United States Patent [19]

Nagelkerke

[11] 4,282,661

[45] Aug. 11, 1981

[54] TOWING SUCTION DEVICE FOR A DREDGING CRAFT

[75] Inventor: Willem Nagelkerke, Oosterhout, Netherlands

[73] Assignee: B.V. Scheepswerf en Reparatie bedrijf "Breebot", Dordrecht, Netherlands

[21] Appl. No.: 89,445

[22] Filed: Oct. 30, 1979

[30] Foreign Application Priority Data

Nov. 1, 1978 [NL] Netherlands ..... 7810861

[51] Int. Cl.[3] ..... E02F 3/90

[52] U.S. Cl. ..... 37/58; 37/72; 285/24

[58] Field of Search ..... 37/72, 58; 285/24, 325; 137/344

[56] References Cited

U.S. PATENT DOCUMENTS

| | | | |
|---|---|---|---|
| 655,997 | 8/1900 | Spurlock | 285/24 X |
| 1,712,312 | 5/1929 | Sensibar | 37/72 |
| 1,853,578 | 4/1932 | Ross | 285/325 |
| 2,651,122 | 9/1953 | Brinkman | 37/72 |
| 3,217,432 | 11/1965 | Joyce | 37/72 |
| 3,490,157 | 1/1970 | Venus | 37/72 |
| 3,630,400 | 12/1971 | De Koning | 37/58 X |
| 4,083,133 | 4/1978 | Ravesteyn et al. | 37/72 |
| 4,123,860 | 11/1978 | De Koning et al. | 31/72 |

FOREIGN PATENT DOCUMENTS

| | | | |
|---|---|---|---|
| 1180686 | 10/1964 | Fed. Rep. of Germany | 37/67 |
| 2420615 | 11/1975 | Fed. Rep. of Germany | 285/325 |
| 7006095 | 12/1970 | Netherlands | 37/58 |
| 7213365 | 4/1974 | Netherlands | 37/66 |
| 7412498 | 3/1975 | Netherlands | 37/72 |
| 156777 | 5/1978 | Netherlands | 37/72 |

*Primary Examiner*—Clifford D. Crowder

*Attorney, Agent, or Firm*—Andrus, Sceales, Starke & Sawall

[57] ABSTRACT

Towing suction device for a dredging craft, which device comprises at least one tube which extends in a dredging position at an angle of inclination with the horizontal outboard along side the craft, in which a displacable tube part is disconnectably coupled with a tube part that is fixedly arranged on board, which parts are disconnected in the non dredging position. A coupling tube section of the displacable tube part is fastened on a slide, which is displacable along a guide track, placed above the water line, between the coupled and the disconnected position. The guiding track is arranged on a deck of the craft, whereas the coupling end of the fixed tube part is arranged near the guide track on the deck. Preferably the slide-guide track unit extends transversely to the longitudinal direction of the craft.

11 Claims, 3 Drawing Figures

TOWING SUCTION DEVICE FOR A DREDGING CRAFT

SUMMARY OF THE INVENTION

The invention relates to a towing suction device for a dredging craft, which device comprises at least one tube which extends in the dredging position at an angle of inclination with the horizontal long side the craft, whereas a movable tube part is detachably coupled with a tube part that has been fixedly arranged on board, which parts are disconnected in the non dredging position.

A towing suction device of this type is known from practice. There the connection between the fixed and the movable tube part has been arranged at the location of an inlet tube in the wall of the craft. This has the objection, that the ships wall has to be reasonably flat at the location of this inlet tube in order to be able to obtain a good sealing of the connection, which means practically that the connection must not be arranged in the bent part but in the straight extending part of the ships wall. As this connection lies mostly below the water line, maintenance works on the connection mostly demand that the dredging craft must enter the dry dock entirely. Also when a towing suction device is mounted later on a existing dredging craft this one has to enter the dry dock, as significant modifications are necessary in the ships structure and wall.

The object of the invention is providing a towing suction device, which can be arranged without significant changes in the ships structure and wall at substantially each location of the dredging craft, or on which a maintenance work can be made, without the dredging craft having to enter the dry dock on most occasions.

This object is reached according to the invention, in that a coupling tube section of the movable suction tube part has been mounted on a slide, which is movable along a guide track, placed above the water line, between the coupled and the disconnected position.

By the application of the invention there is reached, that without the craft having to enter the dry dock, the towing suction device can be mounted on several locations on board of the craft, both on different types of dredging craft, and on crafts, such as splitting barges, elevator barges or any other craft that can be converted into a auto-suction dredging craft.

According to a preferred embodiment of the invention the guiding track has been arranged on the deck of the craft. This has the advantage, that the check of the control of the coupling and detaching operation can be executed very simply, whereas it is not necessary to make any special foundations for the guide track below the deck.

The invention also relates to a towing suction device for a dredging craft, comprising at least one tube, which extends in the dredging position at an angle of inclination with the horizontal outboard along side the craft and is connected to a dredging pump, comprising the dredging pump being arranged in the part of the tube that comes under water in the dredging position.

By arranging the dredging pump in the under water part of the tube a further enlargement is reached of the possibilities of placing the towing suction device at several places of the dredging craft, as it is now also not necessary to construct foundations for the dredging pump.

DESCRIPTION OF THE PREFERRED EMBODIMENT

The invention will now be ellucidated by means of the accompanying drawing of some embodiments.

Figure 1:
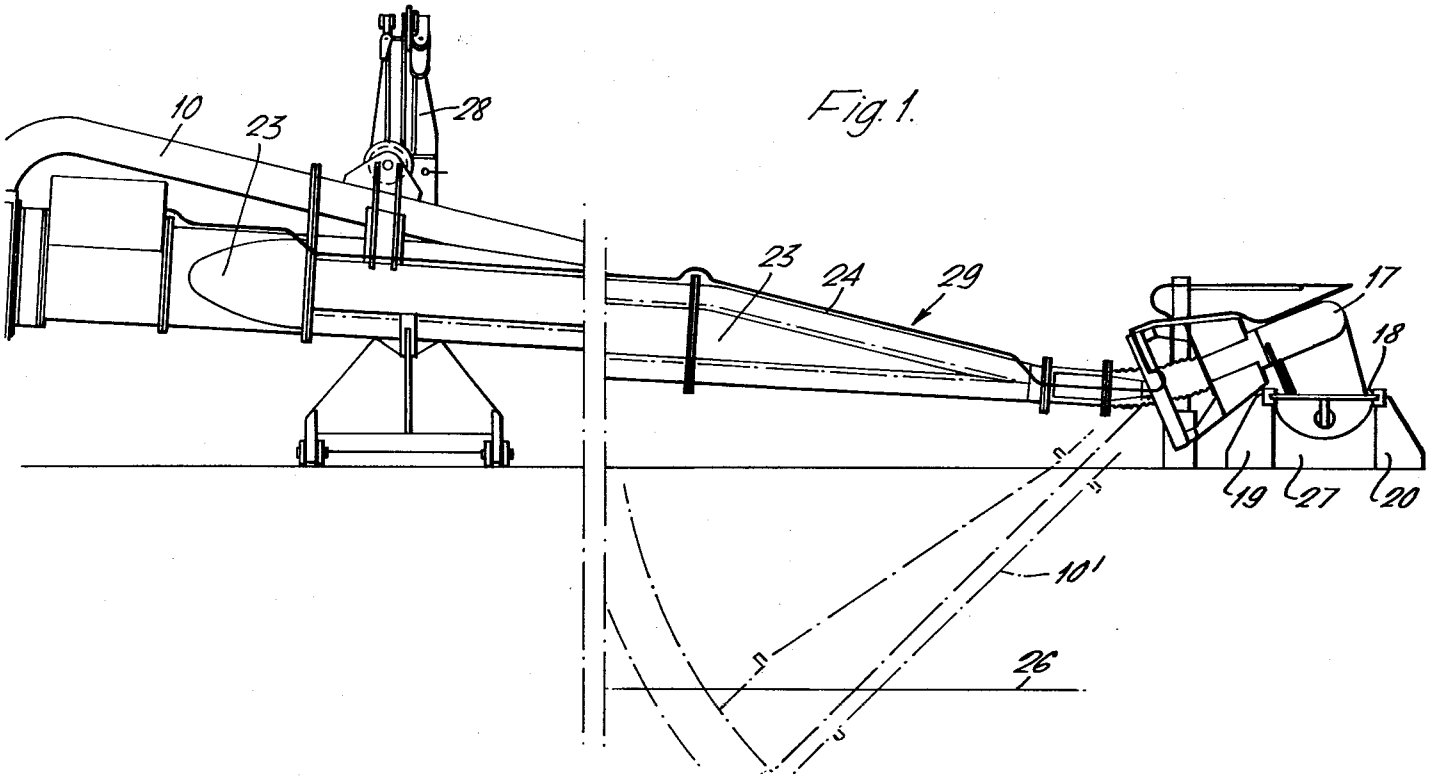
FIG. 1 shows a shortened side view of a towing suction device according to the invention, which is in the rest position.
Figure 2:
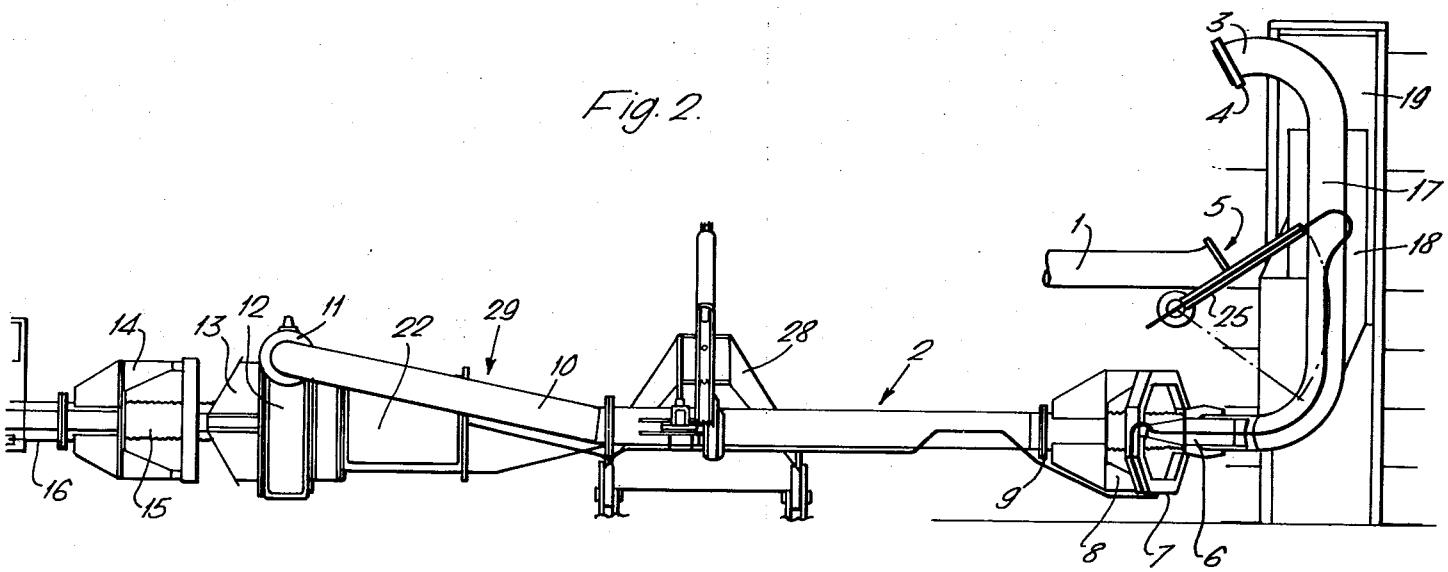
FIG. 2 shows a plan view of the device according to FIG. 1.
Figure 3:
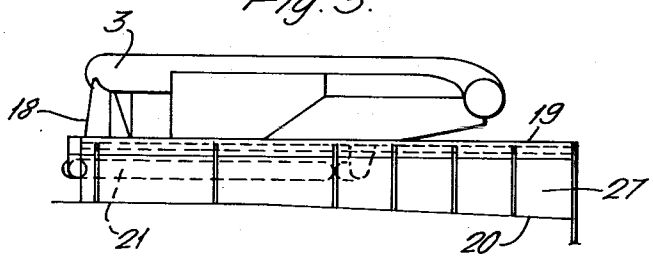
FIG. 3 shows a front view of a device according to FIGS. 1 and 2.

According to the drawing the towing suction device comprises a tube part 1, which is fixedly arranged on board, which tube part 1 can be coupled with a movable tube part that is generally indicated with 2. In the position that is shown in the drawings with solid lines the parts 1 and 2 have been detached from each other, whereas they can also be placed in the dredging position, which is indicated in the drawing with dash-dot lines.

The movable tube part 2 comprises a coupling tube section 3, which is C-shaped in plan view, and a tube section 29 which extends in the longitudinal direction of the craft. The inboard end of the tube section 3 has been provided with a coupling flange 4 which is adapted to be coupled in the dredging position with the coupling flange 5 of the fixedly arranged tube part 1. The outboard end 6 of the C-shaped coupling tube section 3 has been fastened by means of a universal pivot 7 with a flexible hose 8 to the end 9 of pressure tube 10 of which the other end is connected to the outlet 11 of the dredging pump 12. This dredging pump 12 is connected at its inlet 13 by means of a universal pivot 14 with a flexible hose 15 that is connected with the suction tube 16, carrying at its other end a (not shown) suction mouth.

The coupling tube section 3, being C-shaped in plan view, has been fastened with its straight middle part 17 on a slide 18, which can slidably reciprocate over the guiding track 19, that is fastened with a foundation 27 on the deck 20 of the dredging craft. For executing the reciprocating movement of the slide 18 over the guide track 19 a hydraulic piston-cylinder unit 21 has been mounted below the guide track, which unit displaces the coupling tube section 3 between its inboard position, which is drawn with solid lines, and its partly shown outboard position, drawn with dash-dot lines. By means of a number of davits 28, of which only one is shown in the drawing, one lowers the movable tube section 3 with the suction mouth, during which the hose 8 is bent, to the position in which suction dredging is possible. According to FIG. 1 the tube 10 extends therewith in the position 10', under an angle with the vertical, such as has been indicated with dash-dot lines.

Although the dredging pump 12 can be mounted on board of the dredging craft, according to the example shown in the drawing the dredging pump 12 has been mounted in the part of the displacable tube section 2, that comes under water in the dredging position. The drive of the dredging pump 12 takes place by a water tight drive set 22, such as an electric or hydraulic motor which has been mounted at the motor side of the dredge pump and is connected at its other side with a support tube 23, which supports at the upper side the pressure tube 10 for the mixture of dredged matter and water. The support tube 23 narrows at the end which is fastened to the universal pivot 7. The feeding of the drive set 22 takes place by means of an electric cable or by hydraulic hoses 24, which are guided over the tube sections 2 and 3 and come on deck via its own, pivotable carrier 25, which is fastened adjacent to the tube section 1 that is fixedly arranged on deck. The flange 5 that is fastened at the end thereof makes an angle of about 30° with the transverse direction or the direction of displacement of the displacable tube section 3, which angle can also get other values, provided that a good sealing between the coupling flanges 4 and 5 is guaranteed.

The slide-guide track unit 18, 19 extends transversely of the longitudinal direction of the craft, whereas the displacable tube section 2 extends parallel to this longitudinal direction. The slide-guide track unit 18, 19 may be positioned at an end of the hold for the dredged spoil. In FIG. 1 the water level has been indicated at 26.

I claim:

1. A suction device for a dredging craft comprising:

a first tube affixed to said craft for receiving dredging discharge;

a second tube having an upper end and a lower end, said second tube being positionable in a dredging position in which said tube extends along a side of the ship for inserting the lower end thereof in the water, said second tube having a dredging pump connected in the portion thereof that is immersed in the water when said second tube is in the dredging position; and a displaceable tube element having an outboard end coupled to said second tube and an inboard end coupleable to said first tube, said tube element being displaceably mounted on the craft for coupling and disconnection movement generally transversely of the side of the craft between a first position in which said inboard end is coupled to said first tube for delivering dredging discharge and a second position in which said inboard end is disconnected from said first tube.

2. A suction device according to claim 1 further including a guide track fixedly arranged on the deck of the craft transverse to the side, said guide track having a slide thereon mounting said displaceable tube element.

3. A suction device according to claim 2 wherein said guide track and slide are arranged in proximity to said first tube.

4. A suction device according to claim 2 further including hydraulic motor means coupled to said slide for providing the generally transverse coupling and disconnection movement to said displaceable tube element.

5. A suction device according to claim 2 including a suction mouth and wherein said second tube includes a universal joint at the lower end thereof between the suction intake of said dredging pump and said suction mouth.

6. A suction device according to claim 1 or 2 wherein said displaceable tube element is C-shaped, carrying at its inboard end a coupling element adapted for connection to a mating coupling element on said first tube.

7. A suction device according to claim 6 wherein the coupling elements on said displaceable tube element and first tube are arranged at an angle of about 30° with respect to the transverse direction of movement.

8. A suction device according to claim 1 wherein said outboard end of said displaceable tube element is coupled to said second tube through a universal joint including a flexible hose element.

9. A suction device according to claim 1 wherein said displaceable tube element is arranged at an end of the hold of the craft receiving the dredging discharge.

10. The suction device according to claim 1 wherein said dredging pump includes a drive means, said drive means being connected with a support tube fastened to said second tube.

11. The suction device according to claim 10 wherein said drive means comprises at least one of electric and hydraulic motor means.

* * * * *